US009429898B2

(12) United States Patent
Taguchi et al.

(10) Patent No.: US 9,429,898 B2
(45) Date of Patent: Aug. 30, 2016

(54) DEVELOPING CARTRIDGE INCLUDING ELECTRODE AND PROTRUSION

(71) Applicant: Brother Kogyo Kabushiki Kaisha, Nagoya-shi, Aichi-ken (JP)

(72) Inventors: Kazuna Taguchi, Nagoya (JP); Yasuo Fukamachi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/851,021

(22) Filed: Sep. 11, 2015

(65) Prior Publication Data

US 2016/0223983 A1 Aug. 4, 2016

(30) Foreign Application Priority Data

Jan. 30, 2015 (JP) ..... 2015-017786

(51) Int. Cl.
*G03G 21/18* (2006.01)
*G03G 15/08* (2006.01)
*G03G 21/16* (2006.01)

(52) U.S. Cl.
CPC ..... *G03G 21/1652* (2013.01); *G03G 15/0865* (2013.01); *G03G 21/1867* (2013.01)

(58) Field of Classification Search
CPC ..... G03G 21/1867–21/1871
See application file for complete search history.

(56) References Cited

U.S. PATENT DOCUMENTS

| | | | | |
|---|---|---|---|---|
| 7,613,414 | B2 * | 11/2009 | Kamimura | G03G 21/1857 399/111 |
| 7,643,770 | B2 * | 1/2010 | Sato | G03B 21/18 399/111 |
| 7,813,666 | B2 * | 10/2010 | Sato | G03G 15/0813 399/111 |
| 8,494,419 | B2 * | 7/2013 | Shiraki | G03G 15/0818 399/279 |
| 8,938,187 | B2 | 1/2015 | Fukamachi | |
| 9,195,165 | B2 * | 11/2015 | Iriyama | G03G 21/1867 |
| 2013/0051851 | A1 | 2/2013 | Fukamachi | |
| 2015/0125176 | A1 * | 5/2015 | Fujii | G03G 21/1652 399/90 |

FOREIGN PATENT DOCUMENTS

| | | |
|---|---|---|
| JP | 2011-133767 A | 7/2011 |
| JP | 2013-050493 A | 3/2013 |

* cited by examiner

*Primary Examiner* — Clayton E Laballe
*Assistant Examiner* — Leon W Rhodes, Jr.
(74) *Attorney, Agent, or Firm* — Banner & Witcoff, Ltd.

(57) ABSTRACT

A developing cartridge may include a casing, a developing roller, a first protrusion, and an electrode. The casing may be configured to accommodate developer therein. The developing roller may include a developing roller shaft extending in a first direction. The first protrusion may be positioned at an outer surface of the casing. The first protrusion may protrude outward from the outer surface in the first direction. The electrode may be positioned at the outer surface. The electrode may be configured to be electrically connected to the developing roller shaft. The electrode may include a second protrusion protruding outward in the first direction. The second protrusion may have an inner space extending in the first direction. The inner space may be positioned in the second protrusion. The first protrusion may be positioned in the inner space.

15 Claims, 10 Drawing Sheets

DEVELOPING CARTRIDGE INCLUDING ELECTRODE AND PROTRUSION

CROSS REFERENCE TO RELATED APPLICATION

This application claims priority from Japanese Patent Application No. 2015-017786 filed Jan. 30, 2015. The entire content of the priority application is incorporated herein by reference.

TECHNICAL FIELD

The present disclosure relates to a developing cartridge to be assembled in an electro-photographic type image forming apparatus.

BACKGROUND

A developing cartridge attachable to an electro-photographic type image forming apparatus is known in the prior art. The prior art discloses a developing cartridge including a developing roller, and a developing electrode made from electro-conductive resin.

Upon attachment of the developing cartridge to an image forming apparatus, the developing electrode is in contact with an electrode at the image forming apparatus side. Thus, electric power can be supplied from the image forming apparatus to the developing roller through the developing electrode.

SUMMARY

According to the disclosed developing cartridge, the developing electrode protrudes outside in an axial direction of the developing roller because the developing electrode can be in contact with the electrode of apparatus side. Thus, high mechanical strength of the developing electrode is required on the ground that the developing cartridge may drop.

In view of the foregoing, it is therefore an object of the disclosure to provide a developing cartridge capable of providing an increased mechanical strength of the electrode.

In order to attain the above and other objects, the disclosure provides a developing cartridge may include a casing, a developing roller, a first protrusion, and an electrode. The casing may be configured to accommodate developer therein. The developing roller may include a developing roller shaft extending in a first direction. The first protrusion may be positioned at an outer surface of the casing. The first protrusion may protrude outward from the outer surface in the first direction. The electrode may be positioned at the outer surface. The electrode may be configured to be electrically connected to the developing roller shaft. The electrode may include a second protrusion protruding outward in the first direction. The second protrusion may have an inner space extending in the first direction. The inner space may be positioned in the second protrusion. The first protrusion may be positioned in the inner space.

The developing cartridge of the present disclosure can suppress breakage of an electrode.

BRIEF DESCRIPTION OF THE DRAWINGS

The particular features and advantages of the disclosure as well as other objects will become apparent from the following description taken in connection with the accompanying drawings, in which.

DETAILED DESCRIPTION

A developing cartridge according to one embodiment will be described with reference to FIGS. 1 to 10B.

1. Outline of Developing Cartridge

Figure 1:
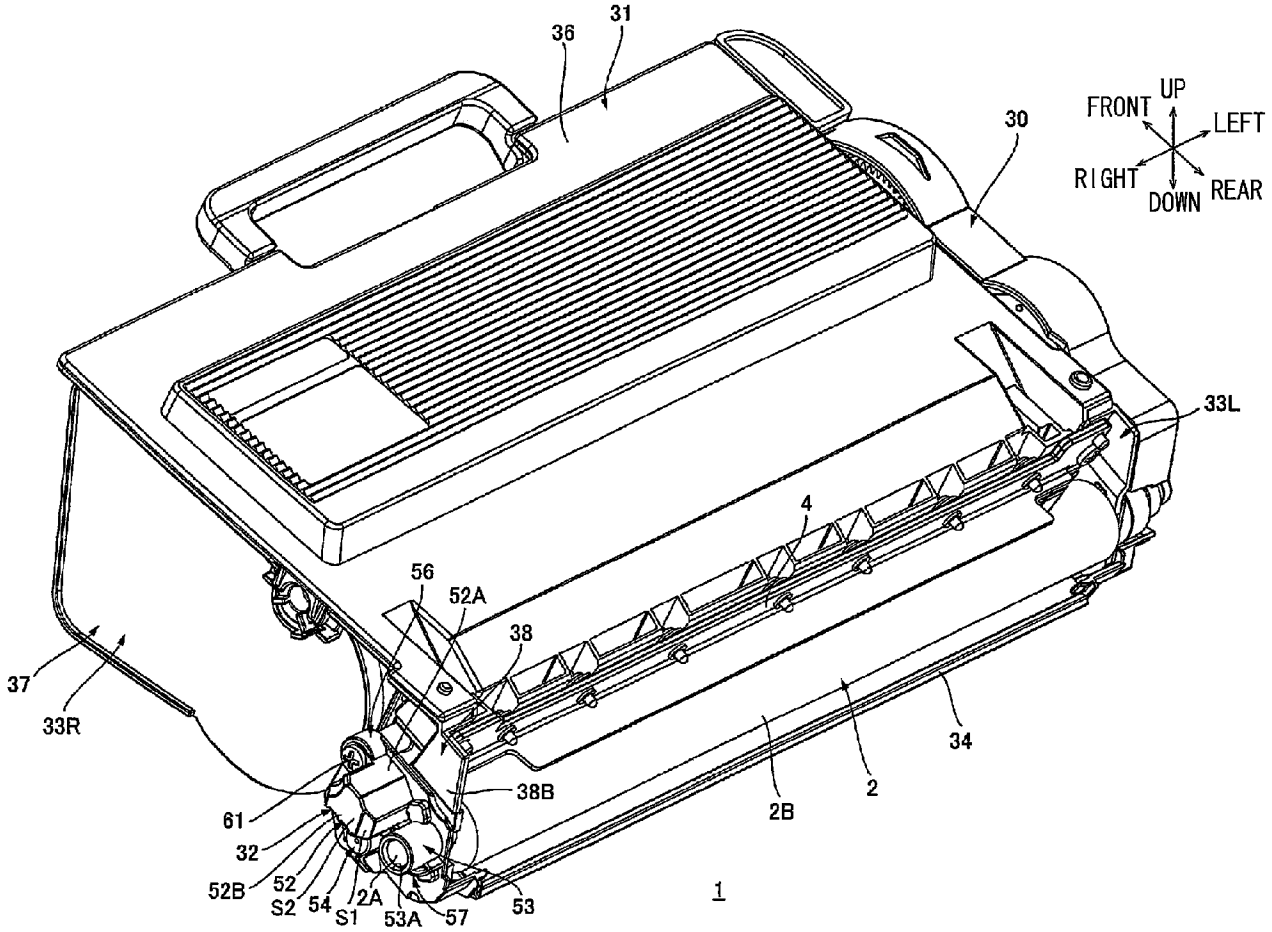
FIG. 1 is an example of a perspective view of a developing cartridge according to one embodiment.
Figure 2:
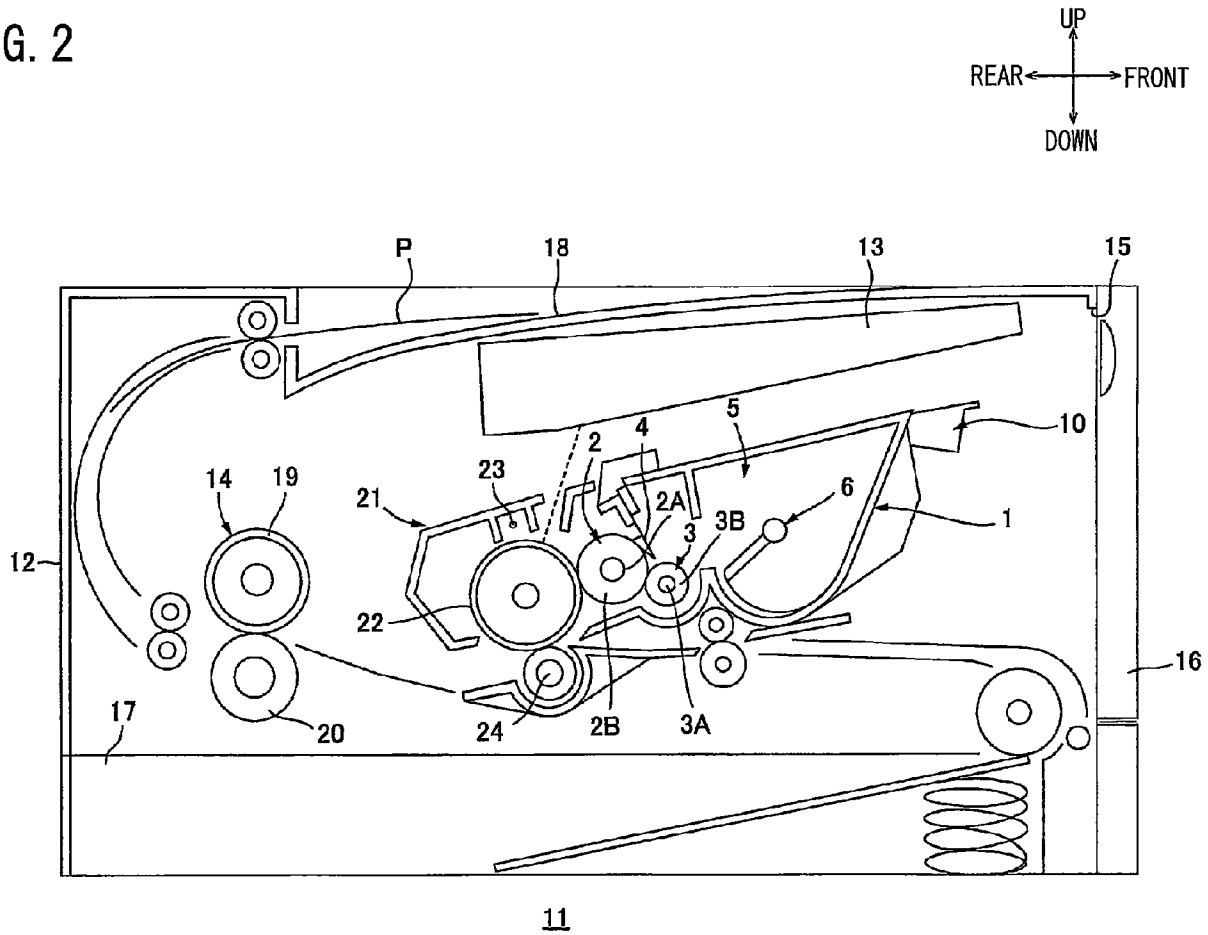
FIG. 2 is an example of a schematic cross-sectional view of a center portion of an image forming apparatus in which the developing cartridge illustrated in FIG. 1 is assembled.

As illustrated in FIGS. 1 and 2, a developing cartridge 1 includes a casing 31, a developing roller 2, a supply roller 3, and a layer thickness regulation blade 4. Regarding directions in the following description, an extending direction of the developing roller 2 will be referred to as the "leftward/rightward direction", and the "upward/downward direction" referred herein is a direction when the developing cartridge 1 is oriented in a horizontal posture. Further, the "frontward/rearward direction" referred herein is a direction determined on the leftward/rightward direction and the upward/downward direction. These directions are exemplified in FIG. 1.

The casing 31 has an internal space defined as a toner accommodating portion 5 configured to accommodate therein toner.

The developing roller 2 is positioned at a rear end portion of the developing cartridge 1 and is rotatably supported by the casing 31. The developing roller 2 includes a developing roller shaft 2A and a roller portion 2B.

The developing roller shaft 2A is cylindrical and extends in the leftward/rightward direction. The roller shaft 2A is made of metal.

The roller portion 2B is hollow cylindrical and extends in the leftward/rightward direction. The roller portion 2B is made of an electrically conductive rubber. The roller portion 2B covers a center of the roller shaft 2A, while left and right end portions of the roller shaft 2A are not covered with the roller portion 2B. Incidentally, the roller portion 2B is positioned between a left wall 33L (described later) and a right wall 33R (described later) of the cartridge frame 31. A portion of the roller portion 2B is exposed to an outside through the cartridge frame 31. The roller shaft 2A penetrates through the roller portion 2B in the leftward/rightward direction. Alternatively, the roller shaft 2A may extend from both ends of the roller portion 2B in the leftward/rightward direction, respectively.

The supply roller 3 is adapted to supply toner in the toner accommodating portion 5 to the developing roller 2. The supply roller 3 is rotatably supported by the casing 31, and is positioned between the developing roller 2 and the toner accommodating portion 5. The supply roller 3 includes a supply roller shaft 3A and a roller portion 3B.

The supply roller shaft 3A is cylindrical and extends in the leftward/rightward direction. The roller shaft 3A is made of metal.

The roller portion 3B is hollow cylindrical and extends in the leftward/rightward direction. The roller portion 3B is made of an electrically conductive sponge. The roller portion 3B covers a center of the roller shaft 3A, while left and right end portions of the roller shaft 3A are not covered with the roller portion 3B. Incidentally, the roller portion 3B is positioned between the left wall 33L (described later) and the right wall 33R (described later) of the cartridge frame 31. A portion of the roller portion 2B is exposed to an outside through the cartridge frame 31. The roller portion 3B is in contact with a surface of the roller portion 2B of the developing roller 2. The roller shaft 3A penetrates through the roller portion 3B in the leftward/rightward direction. Alternatively, the roller shaft 3A may extend from both ends of the roller portion 3B in the leftward/rightward direction, respectively.

The layer thickness regulation blade 4 is adapted to regulate a thickness of a toner layer formed on a surface of the roller portion 2B. The layer thickness regulation blade 4 is in contact with the surface of the roller portion 2B.

The toner accommodating portion 5 accommodates therein the agitator 6. The agitator 6 extends in the leftward/rightward direction and is rotatably supported in the toner accommodating portion 5.

2. Using Manner of Developing Cartridge

As illustrated in FIG. 2, the developing cartridge 1 is installed in an image forming apparatus 11. A combination of the developing cartridge 1 and a drum cartridge 21 constitute a process cartridge 10.

The image forming apparatus 11 is an electro-photographic type monochromatic printer, and includes a housing 12, a scanner unit 13, and a fixing unit 14.

The housing 12 is box shaped whose front end is formed with an opening 15. The housing 12 includes a front cover 16, a sheet tray 17, and a discharge tray 18. The process cartridge 10 can be attached to and detached from the housing 12 through the opening 15.

The front cover 16 is provided at the front end portion of the housing 12 and is plate-shaped. The front cover 16 is configured to open and close the opening 15. The sheet tray 17 is configured to accommodate sheets P.

The drum cartridge 21 includes a photosensitive drum 22, a scorotron charger 23, and a transfer roller 24.

The photosensitive drum 22 is rotatably supported by a frame of the drum cartridge 21. The photosensitive drum 22 has a cylindrical shape extending in the leftward/rightward direction.

The scorotron charger 23 is disposed above the photosensitive drum 22 and is spaced away therefrom.

The transfer roller 24 is positioned below the photosensitive drum 22 and is in contact with the surface of the photosensitive drum 22.

The developing cartridge 1 is attached to the photosensitive drum 22 so that the roller portion 2B of the developing roller 2 is in contact with the surface of the photosensitive drum 22.

The scanner unit 13 is positioned above the process cartridge 10, and is adapted to emit laser beam based on image data to the photosensitive drum 22.

The fixing unit 14 is positioned rearward of the process cartridge 10, and includes a heat roller 19 and a pressure roller 20.

Upon start of the image forming operation in the image forming apparatus 11, the peripheral surface of the photosensitive drum 22 is uniformly charged by the scorotron charger 23 and is exposed to light by the scanner unit 13. Thus, an electrostatic latent image based on the image data is formed on the peripheral surface of the photosensitive drum 22.

The agitator 6 agitates toner in the toner accommodating portion 5 and supplies toner to the supply roller 3. The supply roller 3 supplies toner that has been supplied by the agitator 6 to the developing roller 2. In this case, triboelectric charging is performed between the developing roller 2 and the supply roller 3 so that the toner is charged with positive polarity. The toner is then carried on the developing roller 2. The layer thickness regulation blade 4 regulates thickness of a layer of the toner carried on the developing roller 2 into a uniform thickness.

The toner carried on the developing roller 2 is supplied to the electrostatic latent image on the peripheral surface of the photosensitive drum 22. Thus a toner image is carried on the peripheral surface of the photosensitive drum 22.

Each sheet P is supplied from the sheet tray 17 to a position between the photosensitive drum 22 and the transfer roller 24 at a prescribed timing by the rotation of rollers. Toner image carried on the peripheral surface of the photosensitive drum 22 is transferred onto the sheet P when the sheet P passes through a position between the photosensitive drum 22 and the transfer roller 24.

Thereafter, the sheet P is heated and pressed when the sheet P passes through a position between the heat roller 19 and the pressure roller 20. Thus, the toner image on the sheet P is thermally fixed to the sheet P. Then, the sheet P is discharged onto the discharge tray 18.

3. Details of Developing Cartridge

Figure 3:
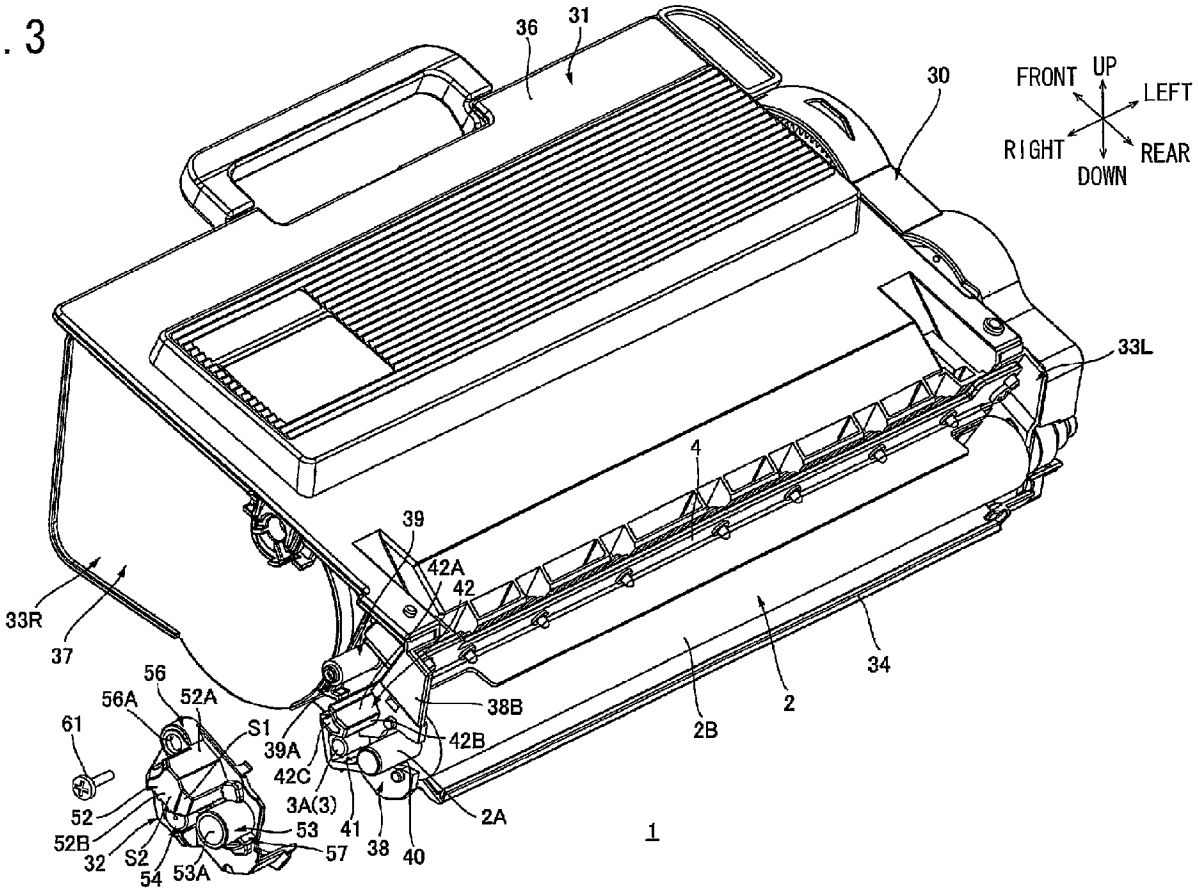
FIG. 3 is an example of a perspective view of the developing cartridge illustrated in FIG. 1 and showing a state where an electrode member is removed.

As illustrated in FIG. 3, the developing cartridge 1 includes the casing 31, a developing electrode 32, and a drive unit 30. In the embodiment, the position of the toner accommodating portion 5 relative to the casing 31 is defined as an inner position. Further, the position opposite to the inner position (the position of the toner accommodating portion 5 relative to the casing 31) is defined as an outer position. Further, an exposed surface of the casing 31 will be referred to as an outer surface of the casing 31.

(1) Casing

Figure 4:
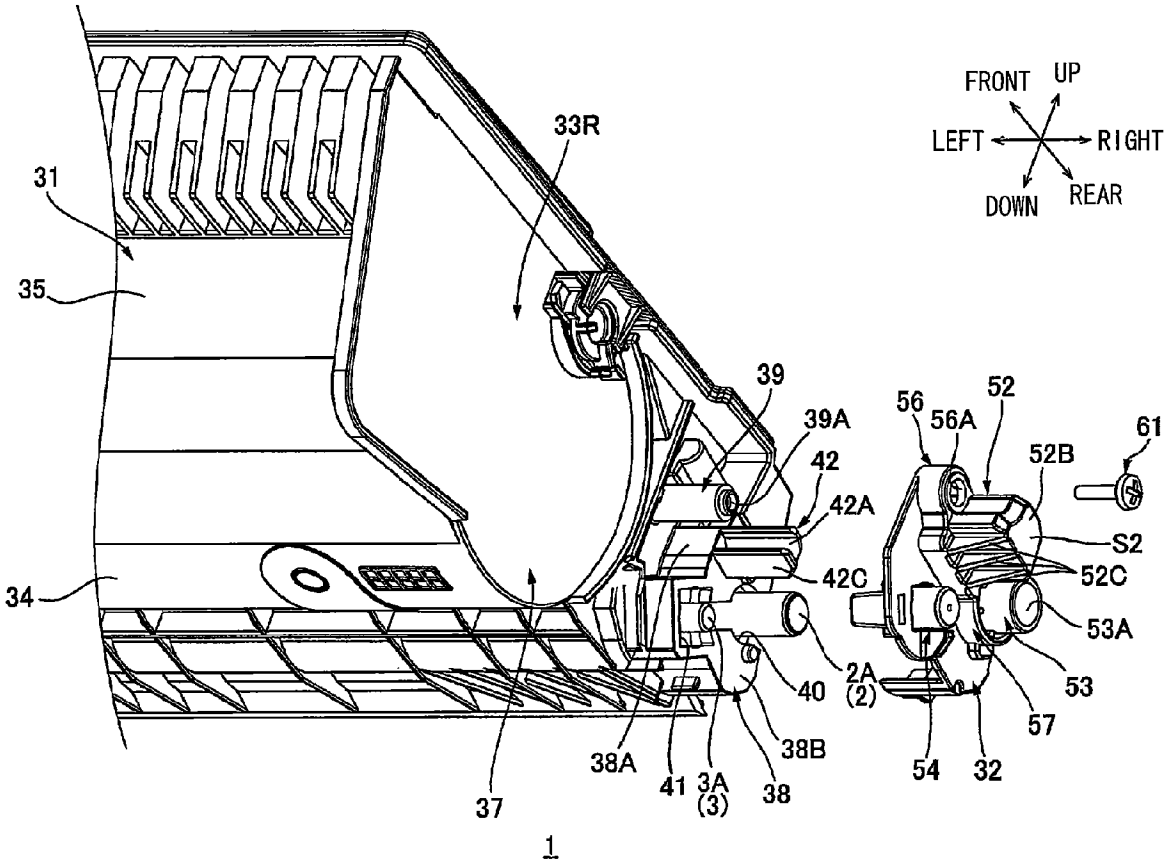
FIG. 4 is an example of an exploded perspective view of the developing cartridge illustrated in FIG. 3 and showing the state where the electrode member is removed.

As illustrated in FIGS. 3 and 4, the casing 31 has a box shape. The casing 31 includes the toner accommodating portion 5 (FIG. 2). The casing 31 supports the developing roller 2 (FIG. 2), the supply roller 3, and the layer thickness regulation blade 4. The casing 31 includes the right wall 33R, the left wall 33L, a lower wall 34, a front wall 35, and an upper wall 36. A space surrounded by the left wall 33L, the right wall 33R, the lower wall 34, the front wall 35, and the upper wall 36 is defined as the toner accommodating portion 5.

The right wall 33R is positioned at the right end portion of the casing 31. Specifically, the right wall 33R is disposed at a position corresponding to one end portion (right end portion) of the developing roller 2 in the leftward/rightward direction. Further, the left wall 33L is positioned at a position corresponding to the other end portion (left end portion) of the developing roller 2 in the leftward/rightward direction. The other end portion is separated from the one end portion of the developing roller 2 and is positioned at the opposite side of the developing roller 2 from the one end portion in the leftward/rightward direction. The right wall 33R has a rectangular plate shape which extends in the frontward/rearward direction and the upward/downward direction. The right wall 33R includes a first right wall 37 and a second right wall 38.

The first right wall 37 constitutes the main part of the right wall 33R in the frontward/rearward direction. The first right wall 37 has a rectangular plate shape which extends in the frontward/rearward direction and the upward/downward direction. The first right wall 37 includes a protrusion 39. The protrusion 39 has a columnar shape and extends outward from the outer surface of the first right wall 37. The protrusion 39 has a screw hole 39A. The screw hole 39A is a circular hole recessed leftward from the right surface of the protrusion 39.

The second right wall 38 is disposed at a position corresponding to the right end portion of the developing roller 2 in the leftward/rightward direction. The second right wall 38 includes a wall 38A and a wall 38B.

The wall 38A has a plate shape which extends from the first right wall 37 in the leftward/rightward direction.

The wall 38B has a plate shape which extends from the right end of the wall 38A in the frontward/rearward direction. The wall 38B includes an insertion hole 40, an insertion hole 41 and a reinforcement protrusion 42.

The insertion hole 40 is positioned at the rear end portion of the wall 38B and penetrates the wall 38B in the leftward/rightward direction. The insertion hole 40 is a hole having a substantial circular shape. The right end portion of the developing roller shaft 2A is inserted into the insertion hole 40 with a play.

The insertion hole 41 is positioned at the front lower side of the insertion hole 40. The insertion hole 41 is a rectangular hole and penetrates the wall 38B in the leftward/rightward direction. The right end portion of the supply roller shaft 3A is inserted into the insertion hole 41 with a play.

Figure 7:
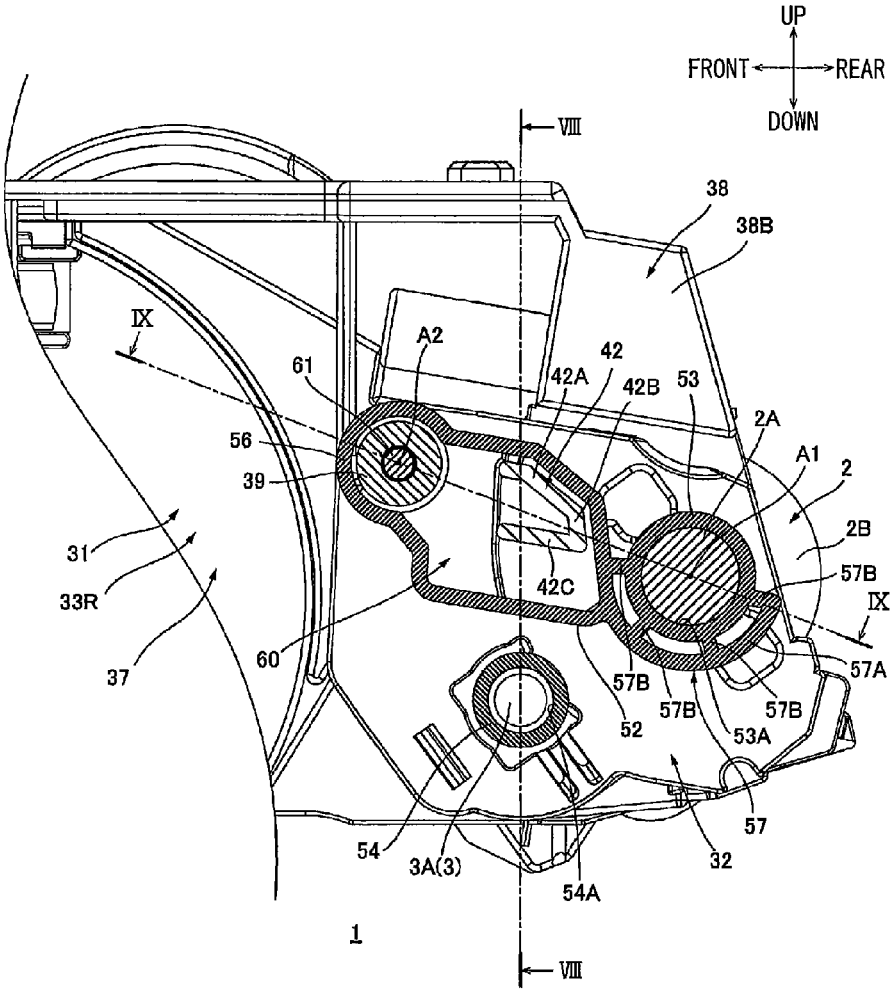
FIG. 7 is an example of a cross-sectional view of the developing cartridge taken along a line VII-VII in FIG. 6.

As illustrated in FIGS. 3 and 7, the reinforcement protrusion 42 is positioned between the protrusion 39 and the insertion hole 40 in the frontward/rearward direction. The reinforcement protrusion 42 protrudes outward from the outer surface of the wall 38B. The length of the reinforcement protrusion 42 from the outer surface of the wall 38B in the leftward/rightward direction is preferably 15.4 mm. The length of the reinforcement protrusion 42 from the outer surface of the wall 38B in the leftward/rightward direction may be no shorter than 14.4 mm and no longer than 16.4 mm. Further, the length of the reinforcement protrusion 42 in the upward/downward direction is preferably 5.9 min. The length of the reinforcement protrusion 42 in the upward/downward direction may be no shorter than 5.4 mm and no longer than 6.4 mm. The reinforcement protrusion 42 has a U-shape when viewed in the leftward/rightward direction.

The protrusion 39 is positioned at the opposite side of the developing roller shaft 2A with respect to the reinforcement protrusion 42. Specifically, the reinforcement protrusion 42 includes an upper reinforcement portion 42A, a rear reinforcement portion 42B, and a lower reinforcement portion 42C.

The upper reinforcement portion 42A is positioned at the upper end portion of the reinforcement protrusion 42. The upper reinforcement portion 42A has a plate shape which extends in the frontward/rearward direction. The length of the upper reinforcement portion 42A in the frontward/rearward direction is 5 mm, preferably. The length of the upper reinforcement portion 42A in the frontward/rearward direction may be no shorter than 4.5 mm and no longer than 5.5 mm.

The rear reinforcement portion 42B is positioned at the rear end portion of the reinforcement protrusion 42. The rear reinforcement portion 42B has a plate shape which extends in the upward/downward direction. Preferably, the length of the rear reinforcement portion 42B in the frontward/rearward direction is 2 mm. Further, the length of the rear reinforcement portion 42B in the frontward/rearward direction may be no shorter than 1.5 mm and no longer than 2.5 mm.

The lower reinforcement portion 42C is positioned at the lower end portion of the reinforcement protrusion 42. The lower reinforcement portion 42C has a plate shape which extends in the frontward/rearward direction. The length of the lower reinforcement portion 42C in the frontward/rearward direction is 6.0 mm, preferably. Further, the length of the lower reinforcement portion 42C in the frontward/rearward direction may be no shorter than 5.5 mm and no longer than 6.5 mm.

As illustrated in FIG. 3, the left wall 33L is located at the left end portion of the casing 31. The left wall 33L has a rectangular plate shape which extends in the frontward/rearward direction and the upward/downward direction. Similarly to the right wall 33R, the left wall 33L has an insertion hole (not illustrated) through which the left end portion of the developing roller shaft 2A is inserted, and an insertion hole (not illustrated) through which the left end portion of the supply roller shaft 3A is inserted.

As illustrated in FIG. 4, the lower wall 34 has a plate shape which extends in the frontward/rearward direction. The lower wall 34 is connected to the right wall 33R and the left wall 33L.

The front wall 35 has a plate shape which extends upward from the front end portion of the lower wall 34 and is connected to the front end portion of the lower wall 34. The front wall 35 is further connected to the right wall 33R and the left wall 33L.

The upper wall 36 has a rectangular plate shape. The upper wall 36 is fixed to the front wall 35, the left wall 33L, and the right wall 33R.

(2) Developing Electrode (2-1) Configuration of Developing Electrode

As illustrated in FIGS. 1, 3, and 4, the developing electrode 32 is attached to the outer surface of the casing 31. Specifically, the developing electrode 32 is attached to the rear end portion of the outer surface of the right wall 33R. The developing electrode 32 is positioned between the developing roller 2 and the agitator 6 (FIG. 2) in the frontward/rearward direction. The developing electrode 32 is made of a conductive resin. The developing electrode 32 includes a developing roller bearing 53, a supply roller bearing 54, a protrusion 52, and a reinforcement portion 57. As illustrated in FIG. 1, the protrusion 52 of the developing electrode 32 protrudes outward from the right wall 33R when the developing electrode 32 is attached to the outer surface of the right wall 33R.

Figure 5A:
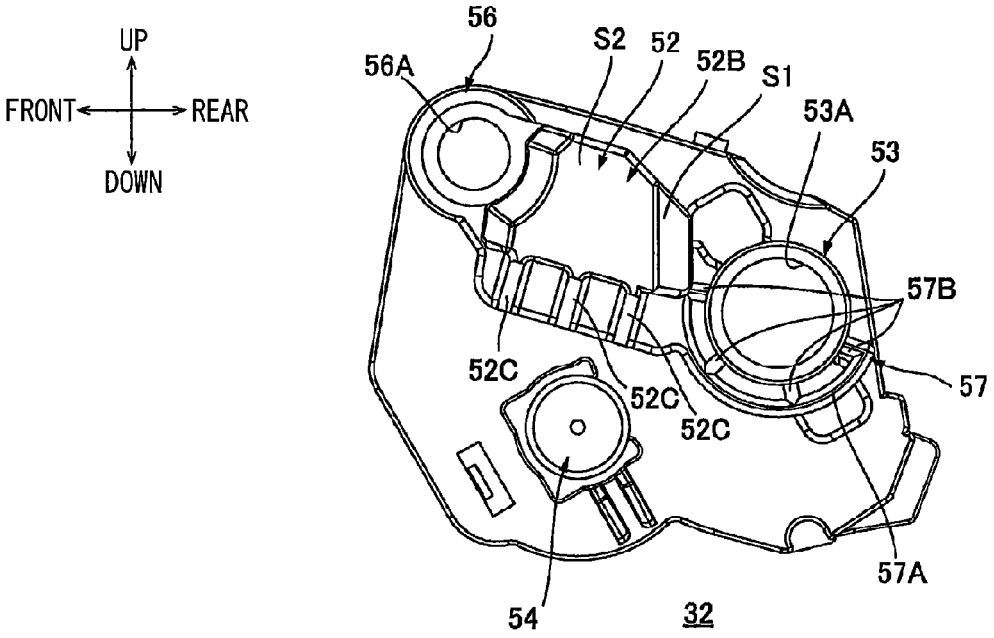
FIG. 5A is an example of a right side view of the electrode member illustrated in FIG. 3.
Figure 5B:
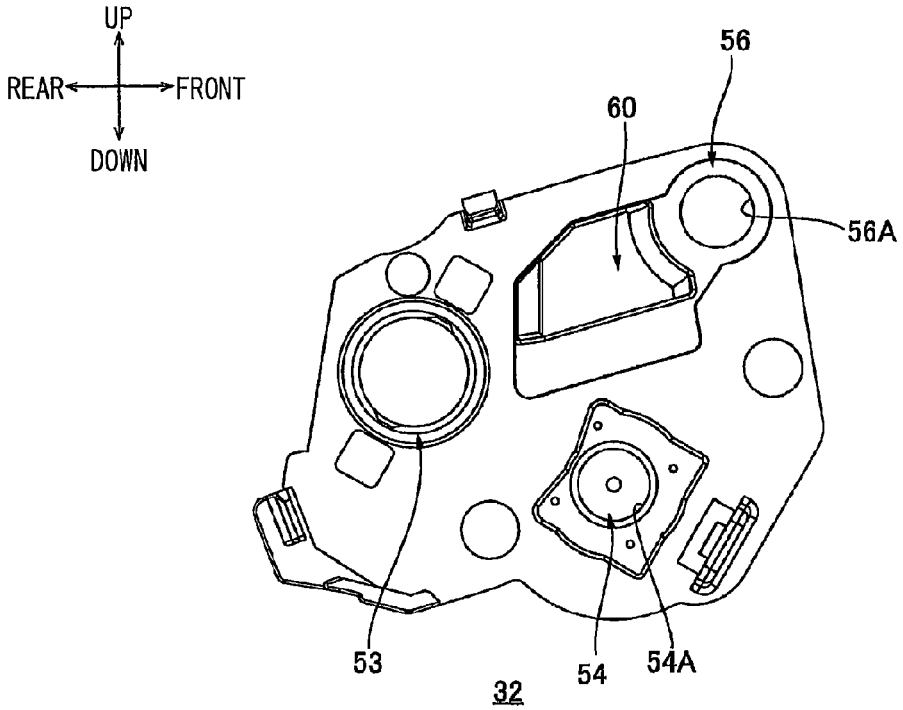
FIG. 5B is an example of a left side view of the electrode member illustrated in FIG. 3.

As illustrated in FIGS. 4, 5A, and 5B, the developing roller bearing 53 has a cylindrical shape which extends from the developing electrode 32 in the leftward/rightward direction. The cylindrical shape extending in the leftward/rightward direction is preferably 12.1 mm. Further, the length of the cylindrical shape extending in the leftward/rightward direction may be no shorter than 11.9 mm and no longer than 12.3 mm.

The developing roller bearing 53 has an insertion hole 53A into which the right end portion of the developing roller shaft 2A is rotatably fitted. When the peripheral surface of the right end portion of the developing roller shaft 2A contacts the developing roller bearing 53, the developing electrode 32 is electrically connected to the developing roller shaft 2A. Further, the insertion hole 53A of the developing roller bearing 53 may be different from a through hole, as long as the insertion hole 53A is a hole into which the right end portion of the developing roller shaft 2A is rotatably fitted. The diameter of the insertion hole 53A is 7.55 mm, preferably. Further, the diameter of the insertion hole 53A may be no shorter than 7.52 mm and no longer than 7.58 mm.

As illustrated in FIGS. 4, 5A, and 5B, the supply roller bearing 54 has a cylindrical shape which extends from the developing electrode 32 in the leftward/rightward direction. Preferably, the length of the cylindrical shape extending in the leftward/rightward direction of the supply roller bearing 54 is 6.3 mm. Further, the length of the cylindrical shape extending in the leftward/rightward direction of the supply roller bearing 54 may be no shorter than 6.1 mm and no longer than 6.5 mm. The right end of the supply roller bearing 54 is closed. The supply roller bearing 54 includes an insertion hole 54A into which the right end portion of the supply roller shaft 3A is rotatably fitted. When the peripheral surface of the right end portion of the supply roller shaft 3A contacts the supply roller bearing 54, the developing electrode 32 is electrically connected to the supply roller shaft 3A.

Further, the insertion hole 54A of the supply roller bearing 54 may be a through hole, as long as the insertion hole 54A is a hole into which the right end portion of the supply roller shaft 3A is rotatably fitted. The diameter of the insertion hole 54A is 5.05 mm, preferably. Further, the diameter of the insertion hole 54A may have a size equal to or larger than 5.02 mm and equal to or smaller than 5.08 mm.

In this way, the developing electrode 32 serves as bearings for supporting the developing roller shaft 2A and the supply roller shaft 3A.

As illustrated in FIGS. 4 and 5A, the protrusion 52 protrudes outward in the leftward/rightward direction. The protrusion 52 has a prismatic shape which extends in the leftward/rightward direction. Preferably, the projection amount of the protrusion 52 is 17.6 mm. Further, the protrusion amount of the protrusion 52 may be no shorter than 15.6 mm and no longer than 19.6 mm. The protrusion 52 includes an upper end surface 52A (FIGS. 1 and 3), a right end surface 52B, a reinforcement rib 52C, and a fixed portion 56.

The upper end surface 52A is the upper portion of the protrusion 52. The upper end surface 52A extends in the leftward/rightward direction.

The right end surface 52B is the right end portion of the protrusion 52. The right end surface 52B is a surface which extends in the frontward/rearward direction. The right end surface 52B includes a first surface S1 and a second surface S2.

Figure 6:
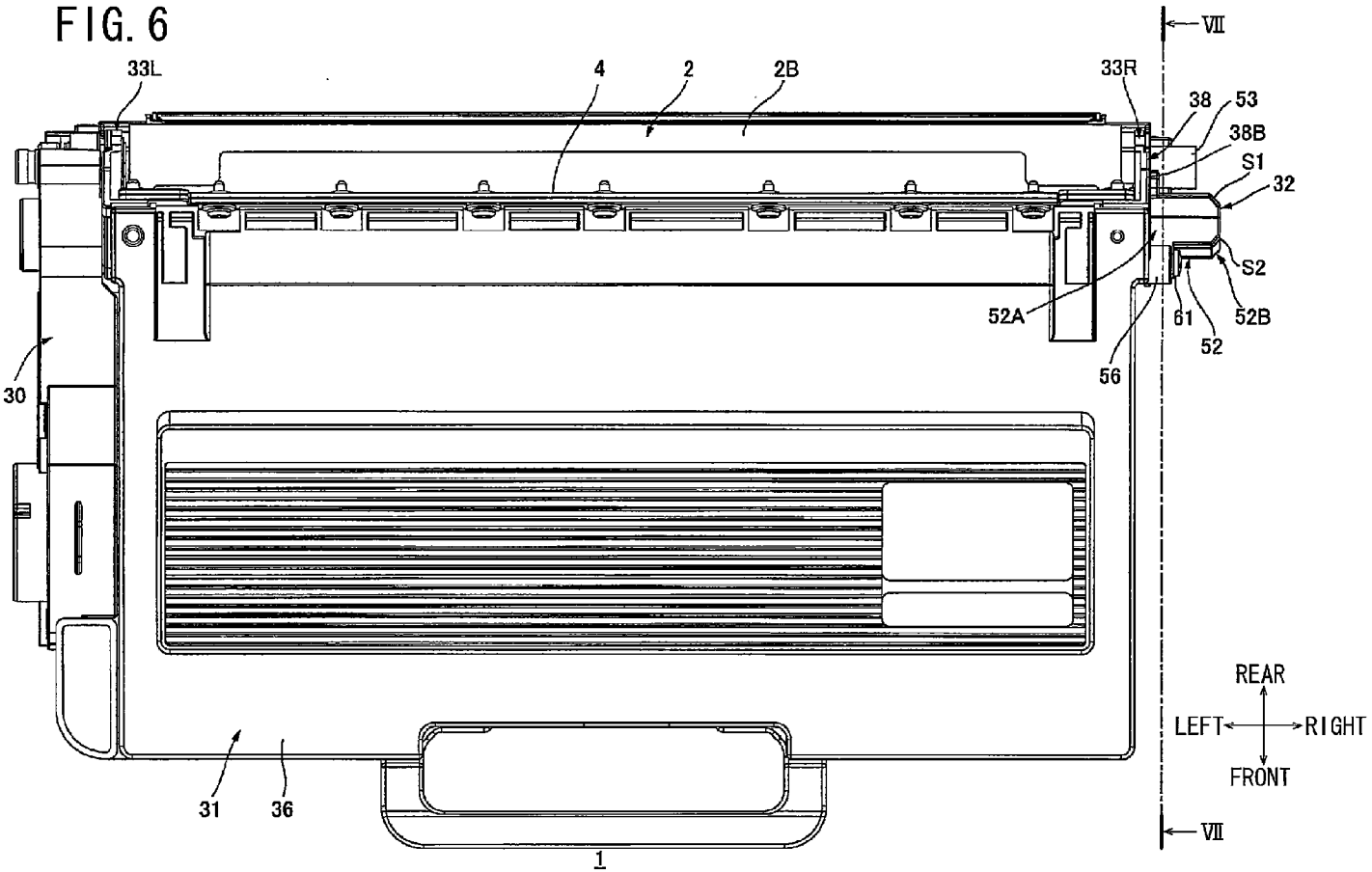
FIG. 6 is an example of a plan view of the developing cartridge illustrated in FIG. 1.

The second surface S2 is a surface which extends in the leftward/rightward direction. In the embodiment, the second surface S2 extends in parallel to the right wall 33R as shown in FIG. 6. The second surface S2 is farther from the right wall 33R than the developing roller bearing 53 in the leftward/rightward direction.

As illustrated in FIGS. 5A and 5B, the first surface S1 is positioned between the developing roller bearing 53 and the second surface S2 in the frontward/rearward direction. In other words, as illustrated in FIG. 1, the first surface S1 is positioned between the developing roller 2 and the second surface S2 in the frontward/rearward direction. Further, the first surface S1 is connected to the second surface S2. The first surface S1 is an inclined surface such that the larger the distance from the right wall 33R is, the closer to the second surface S2 a part of the first surface S1 is.

The plurality of reinforcement ribs 52C includes ribs each reinforcing the protrusion 52. As shown in FIG. 4, each reinforcement rib 52C is positioned at the lower surface of the protrusion 52 and extends in the leftward/rightward direction. The plurality of the reinforcement ribs 52C is disposed with a gap therebetween in the frontward/rearward direction. Specifically, three reinforcement ribs 52C are disposed with a gap therebetween in the frontward/rearward direction. Each reinforcement rib 52C protrudes downward from the lower surface of the protrusion 52. The length of each reinforcement rib 52C in the upward/downward direction is shortened as the distance from the right wall 33R increases.

As illustrated in FIG. 5B, the protrusion 52 has a space 60 therein. The space 60 extends in the leftward/rightward direction. The space 60 is defined by an inner surface of the protrusion 52. The reinforcement protrusion 42 is positioned in the space 60. Specifically, the reinforcement protrusion 42 is inserted into the space 60 and is positioned inside the protrusion 52. The space 60 has a size so that the reinforcement protrusion 42 is insertable. Preferably, the length of the space 60 in the leftward/rightward direction is 16.5 mm. Further, the length of the space 60 in the leftward/rightward direction may be no shorter than 15.5 mm and no longer than 17.5 mm.

As illustrated in FIGS. 4 and 5B, the fixed portion 56 has a cylindrical shape which extends in the leftward/rightward direction. Preferably, the length of the cylindrical shape extending in the leftward/rightward direction of the fixed portion 56 is 6.6 mm. Further, the length of the cylindrical shape extending in the leftward/rightward direction of the fixed portion 56 may be no shorter than 6.4 mm and no longer than 6.8 mm. The protrusion 52 includes one end portion and other end portion further from the developing roller shaft 2A than the one end portion of the protrusion, and the fixed portion 56 is provided on the other portion of the protrusion 52. The other end portion of the protrusion 52 is farther from the developing roller shaft 2A than the one end portion of the protrusion 52 in the front/read direction. The one end portion of the protrusion 52 is positioned closer to the developing roller shaft 2A in the frontward/rearward direction than the other end portion of the protrusion 52. The fixed portion 56 has a screw insertion hole 56A into which the right end portion of the protrusion 39 is insertable. The screw insertion hole 56A has a size so that the right end portion of the protrusion 39 is insertable.

The screw insertion hole 56A penetrates the fixed portion 56 in the leftward/rightward direction. The screw insertion hole 56A is a circular hole. The diameter of the screw insertion hole 56A is preferably 4.98 mm. Further, the diameter of the screw insertion hole 56A may be no shorter than 4.97 mm and no longer than 4.99 mm.

As illustrated in FIGS. 4 and 5A, the reinforcement portion 57 is positioned below the developing roller bearing 53. The reinforcement portion 57 includes a surrounding portion 57A and a plurality of connection portions 57B.

The surrounding portion 57A extends in the leftward/rightward direction so as to surround the developing roller bearing 53. The surrounding portion 57A is curved along the peripheral surface of the developing roller bearing 53.

The connection portions 57B are positioned between the surrounding portion 57A and the developing roller bearing 53. Specifically, four connection portions 57B are disposed in the circumferential direction of the developing roller bearing 53 with a gap between two adjacent connection portions 57B. Each connection portion 57B connects the surrounding portion 57A and the developing roller bearing 53.

(2-2) Attachment of Developing Electrode

As illustrated in FIGS. 1 and 6, the developing electrode 32 is attached to the outer surface of the right wall 33R of the casing 31 by a screw 61.

Specifically, when the developing electrode 32 is attached to the outer surface of the right wall 33R, the right end portion of the developing roller shaft 2A is rotatably fitted into the insertion hole 53A of the developing roller bearing 53 as illustrated in FIG. 7. When the surface of the right end portion of the developing roller shaft 2A contacts the developing roller bearing 53, the developing electrode 32 is electrically connected to the developing roller shaft 2A.

The right end portion of the supply roller shaft 3A is rotatably fitted into the insertion hole 54A of the supply roller bearing 54. When the surface of the right end portion of the supply roller shaft 3A contacts the supply roller bearing 54, the developing electrode 32 is electrically connected to the supply roller shaft 3A.

Figure 8:
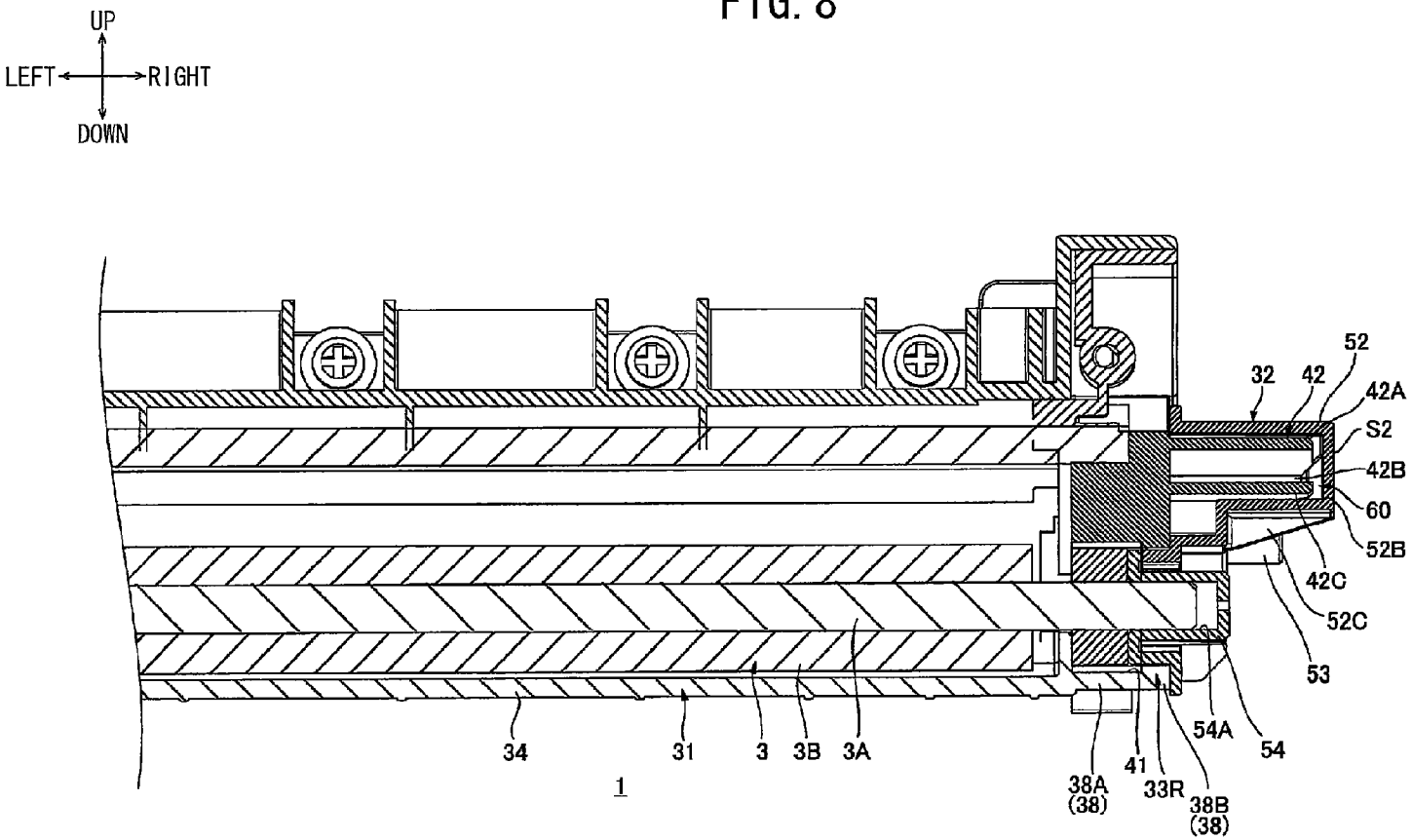
FIG. 8 is an example of a cross-sectional view of the developing cartridge taken along a line VIII-VIII in FIG. 7.

As illustrated in FIGS. 7 and 8, the reinforcement protrusion 42 is positioned inside the space 60. Specifically, as illustrated in FIG. 7, the reinforcement protrusion 42 is positioned in a part of the space 60 corresponding to the one end portion of the protrusion 52, and the one end portion of the protrusion 52 is closer to the developing roller shaft 2A than the other end portion of the protrusion 52. In other words, the reinforcement protrusion 42 is not positioned in the other part of the space 60 corresponding to the other end portion of the protrusion 52, and the other end portion of the protrusion 52 is farther from the developing roller shaft 2A than the one end portion of the protrusion 52. Specifically, the upper reinforcement portion 42A of the reinforcement protrusion 42 extends along the inner surface of the upper portion of the protrusion 52. The rear reinforcement portion 42B of the reinforcement protrusion 42 extends along the inner surface of the rear end portion of the protrusion 52. The lower reinforcement portion 42C of the reinforcement protrusion 42 extends along the inner surface of the lower end portion of the right end surface 52B of the protrusion 52.

Figure 9:
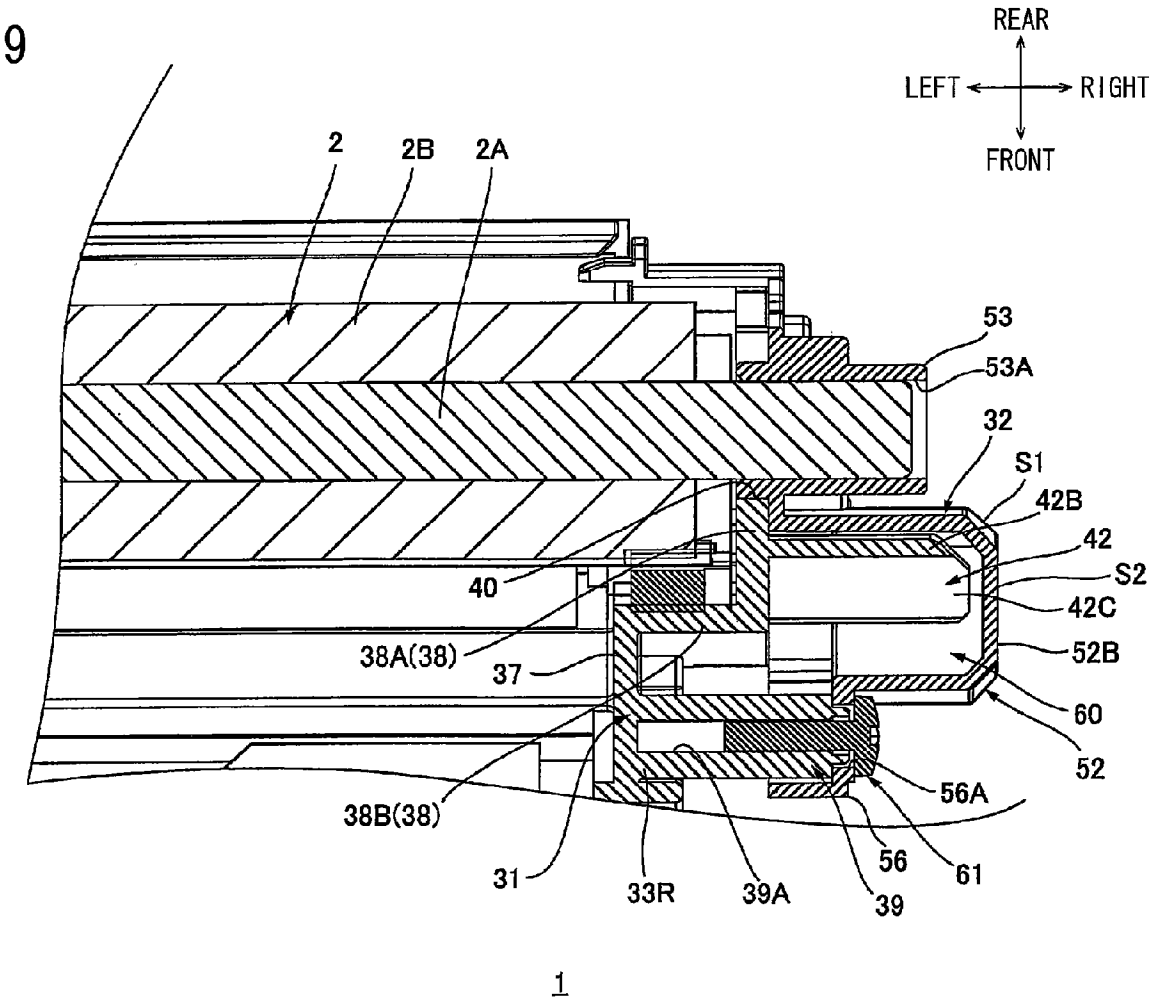
FIG. 9 is an example of a cross-sectional view of the developing cartridge taken along a line IX-IX in FIG. 7.

As illustrated in FIGS. 8 and 9, the right end of the reinforcement protrusion 42 is farther from the right wall 33R than the right end of the developing roller shaft 2A. In other words, the right end of the reinforcement protrusion 42 is disposed outside the right end of the developing roller 2A in the left/right direction.

As illustrated in FIGS. 7 to 9, the right end portion of the protrusion 39 is positioned inside the screw hole 56A of the fixed portion 56. That is, the right end portion of the protrusion 39 is inserted into the screw hole 56A of the fixed portion 56 in the leftward/rightward direction. Then, the fixed portion 56 is fixed to the protrusion 39 when the screw 61 is inserted into the screw insertion hole 56A.

Further, as illustrated in FIGS. 1 and 7, the protrusion 52 of the developing electrode 32 is positioned between the axis A1 of the developing roller shaft 2A and the axis A2 of the screw 61 in the frontward/rearward direction.

(3) Drive Portion

As illustrated in FIG. 1, the drive unit 30 is positioned at the outer surface of the left wall 33L. The drive unit 30 includes, for example, a gear train including a plurality of gears. The gear train (not shown) includes a gear which rotates the developing roller shaft 2A. Further, the gear train (not shown) further includes a gear which rotates the supply roller shaft 3A.

4. Attachment of Developing Cartridge to Housing

When the developing cartridge 1 is attached to the housing 12, the developing cartridge 1 is attached to the drum cartridge 21 and the developer cartridge 1 is inserted into the housing 12 in a state where the developer cartridge 1 is attached to the drum cartridge 21.

Figure 10A:
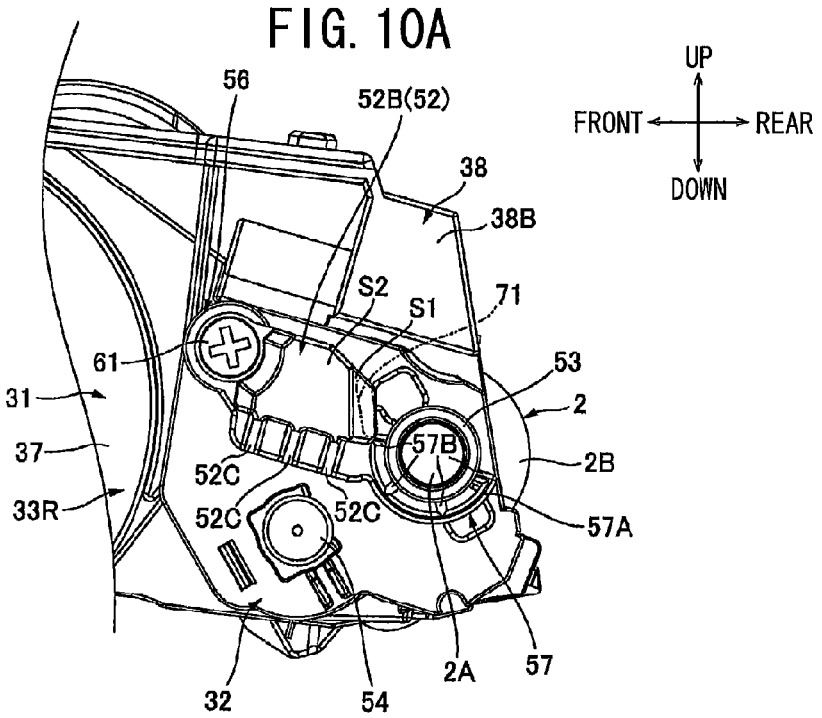
FIG. 10A is an example of a view for description of the developing cartridge partially assembled to a housing of the image forming apparatus, and showing a state where an electrode of the image forming apparatus is brought into contact with a rear end portion of the developing electrode.

When the developing cartridge 1 is inserted into the housing 12, an electrode 71 provided inside the housing 12 contacts the first surface S1 of the protrusion 52 as illustrated in FIG. 10A. Then, the electrode 71 slides on the first surface S1 and is guided along the first surface S1 toward the second surface S2.

Figure 10B:
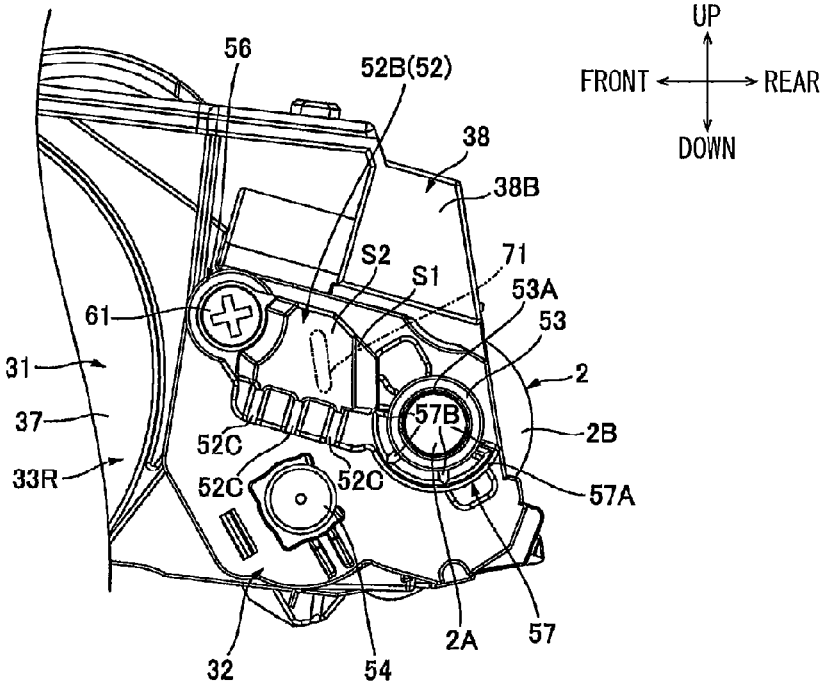
FIG. 10B is an example of a view for description of the developing cartridge fully assembled to the housing of the image forming apparatus, and showing a state where the electrode of the image forming apparatus is in contact with a right surface of the developing electrode.

When the developing cartridge 1 is further inserted into the housing 12, the electrode 71 contacts the second surface S2 of the protrusion 52 as illustrated in FIG. 10B. Then, the attachment of the developing cartridge 1 to the housing 12 is completed. Accordingly, the developing electrode 32 can receive the electric power via the electrode 71.

5. Correspondence Relationships

The toner is an example of developer. The outer surface of the right wall 33R is an example of an outer surface of the casing. The leftward/rightward direction is an example of a first direction. The reinforcement protrusion 42 is an example of a first protrusion. The developing electrode 32 is an example of an electrode. The protrusion 52 is an example of a second protrusion. The space 60 is an example of a space. The one end portion of the protrusion 52 is an example of a first end portion. The fixed portion 56 is an example of a second end portion. The frontward/rearward direction is an example of a second direction crossing the first direction. The protrusion 39 is an example of a third protrusion. The screw 61 is an example of a fixing member. The screw hole 56A is an example of a through hole. The right end surface 52B is an example of a portion of the second protrusion between an axis of the developing roller shaft and an axis of the screw. The first right wall 37 is an example of a first surface. The second right wall 38 is an example of a second surface. The right end of the reinforcement protrusion 42 is an example of an outer end of the first protrusion. The right end of the protrusion 52 is an example of an outer end of the second protrusion. The roller portion 2B is an example of a roller member. The right wall 33R is an example of a first wall. The left wall 33L is an example of a second wall. The right surface of the right wall 33R is an example of an outer surface of the first wall. The image forming apparatus 11 is an example of an image forming apparatus. The electrode 71 is an example of an electrical contact. The developing roller bearing 53 is an example of a bearing. The supply roller bearing 54 is an example of a bearing.

6. Effects (1) According to the developing cartridge 1, as illustrated in FIGS. 7 and 9, the reinforcement protrusion 42 positioned at the outer surface of the right wall 33R of the casing 31 is positioned inside the space 60 defined by the right end surface 52B of the developing electrode 32. With this construction, the protrusion 52 of the developing electrode 32 can be reinforced by the reinforcement protrusion 42.

(2) According to the developing cartridge 1, the reinforcement protrusion 42 extends from the outer surface of the right wall 33R of the casing 31 as illustrated in FIG. 3. Since the reinforcement protrusion 42 extends from the outer surface of the right wall 33R, the rigidity of the reinforcement protrusion 42 can be improved. As a result, the protrusion 52 of the developing electrode 32 can be further reinforced.

(3) According to the developing cartridge 1, the developing electrode 32 is configured to be electrically connected to the supply roller shaft 3A at the supply roller bearing 54 as illustrated in FIG. 7. With this construction, electric power can be supplied to both the developing roller 2 and the supply roller 3 via the developing electrode 32, and the protrusion 52 of the developing electrode 32 can be reinforced by the reinforcement protrusion 42.

(4) According to the developing cartridge 1, the reinforcement protrusion 42 is positioned at one end portion of the protrusion 52 near the developing roller shaft 2A, as illustrated in FIG. 9. With this construction, the one end portion of the protrusion 52 closer to the developing roller shaft 2A can be reliably reinforced.

(5) According to the developing cartridge 1, the fixed portion 56 of the protrusion 52 is fixed to the protrusion 39 by the screw 61 as illustrated in FIGS. 9 and 10A. Accordingly, the other end portion of the protrusion 52 farther from the developing roller shaft 2A than the one end portion of the protrusion 52 in the frontward/rearward direction can be reinforced by the fixed portion 56, the screw 61, and the protrusion 39.

(6) According to the developing cartridge 1, the protrusion 52 has a portion positioned between the axis A1 of the developing roller shaft 2A and the axis A2 of the screw 61 in the frontward/rearward direction, as illustrated in FIGS. 7 and 10A. With this configuration, the developing roller shaft 2A and the screw 61 can protect the front portion and the rear portion of the protrusion 52.

(7) According to the developing cartridge 1, as illustrated in FIG. 7, the developing electrode 32 includes the developing roller bearing 53 supporting the developing roller shaft 2A, and the supply roller bearing 54 supporting the supply roller shaft 3A. With this construction, the developing electrode 32 can supply the electrical power to the developing roller shaft 2A and the supply roller shaft 3A while bearing the developing roller shaft 2A and the supply roller shaft 3A.

Accordingly, the configuration of the developing cartridge 1 can be simplified without separately providing other bearings for supporting the developing roller shaft 2A and the supply roller shaft 3A.

(8) According to the developing cartridge 1, as illustrated in FIGS. 3 and 4, the reinforcement protrusion 42 protrudes from the right surface of the wall 38B and the protrusion 39 protrudes from the outer surface of the first right wall 37. With this configuration, the reinforcement protrusion 42 and the protrusion 39 can be provided in different walls.

(9) According to the developing cartridge 1, as illustrated in FIG. 9, the right end portion of the reinforcement protrusion 42 is farther from the outer surface of the right wall 33R than the right end portion of the developing roller shaft 2A is. Accordingly, the protrusion 52 of the developing electrode 32 can be reliably reinforced by the reinforcement protrusion 42.

(10) According to the developing cartridge 1, the developing electrode 32 is made of a conductive resin. Therefore, the developing electrode 32 can be easily molded by a conductive resin.

(11) According to the developing cartridge 1, as illustrated in FIG. 10A, the developing electrode 32 is attached to the outer surface of the right wall 33R of the casing 31 by the screw 61. With this construction, the developing electrode 32 can be attached to the outer surface of the casing 31 with a simple configuration.

(12) According to the developing cartridge 1, as illustrated in FIG. 10B, the protrusion 52 of the developing electrode 32 contacts the electrode 71 of the image forming apparatus 11 when the developing cartridge 1 is attached to the image forming apparatus 11. With this construction, the electric power can be supplied from the image forming apparatus 11 to the developing roller 2 and the supply roller 3 via the developing electrode 32.

7. Modifications and Variations

In the above described embodiment, the reinforcement protrusion 42 extends from the outer surface of the right wall 33R, but the embodiment is not limited thereto. For example, a reinforcement protrusion may be positioned in the space 60 and extend along the space 60. Further, a reinforcement protrusion extending along the space 60 may be attached to the outer surface of the right wall 33R.

Further, in the embodiment, the developing roller shaft 2A is directly connected to the developing roller bearing 53, but the embodiment is not limited thereto, as long as the developing roller shaft 2A and the developing roller bearing 53 can be electrically connected to each other. The developing roller shaft 2A may be indirectly connected to the developing roller bearing 53. For example, the developing roller shaft 2A may be electrically connected to the developing roller bearing 53 via a conductive metal member. Further, the developing roller shaft 2A may be electrically connected to the developing electrode 32 via a conductive metal member.

Further, in the embodiment, the supply roller shaft 3A is directly connected to the supply roller bearing 54, but the embodiment is not limited thereto, as long as the supply roller shaft 4A and the supply roller bearing 54 can be electrically connected to each other. The supply roller shaft 3A and the supply roller bearing 54 may be indirectly connected to each other. For example, the supply roller shaft 3A and the supply roller bearing 54 may be electrically connected to each other via a conductive metal member. Further, the supply roller shaft 3A may be electrically connected to the developing electrode 32 via a conductive metal member.

Further, in the embodiment, as illustrated in FIGS. 7 and 8, the reinforcement protrusion 42 is positioned inside the space 60 of the protrusion 52. Specifically, as shown in FIG. 7, the reinforcement protrusion 42 is positioned in one end portion of the protrusion 52 near the developing roller shaft 2A, but is not positioned in the other end portion of the protrusion 52 separated from the developing roller shaft 2A. At least a part of the reinforcement protrusion 42 may be positioned at the other end portion of the protrusion 52 separated from the developing roller shaft 2A.

In the above-described embodiment, the developing electrode 32 is attached to the casing 31 by the screw 61, but the method of attaching the developing electrode 32 to the casing 31 is not particularly limited. For example, the developing electrode 32 can be attached to the casing 31 by a method such as welding. In that case, the welded portion is an example of the fixed portion.

While the disclosure has been described in detail with reference to the specific example embodiment thereof, this is merely an example, and various changes, arrangements and modifications may be applied therein without departing from the spirit and scope of the disclosure.

What is claimed is:

1. A developing cartridge comprising:

a casing configured to accommodate developer therein;

a developing roller including a developing roller shaft extending in a first direction;

a first protrusion positioned at an outer surface of the casing, the first protrusion being rigid and protruding outward from the outer surface in the first direction; and an electrode positioned at the outer surface, the electrode configured to be electrically connected to the developing roller shaft, the electrode including a second protrusion protruding outward in the first direction and the second protrusion having an inner space extending in the first direction, the inner space being positioned in the second protrusion, wherein the first protrusion is positioned in the inner space, and wherein the second protrusion covers a distal end of the first protrusion.

2. The developing cartridge according to claim 1, wherein the first protrusion extends from the outer surface of the casing.

3. The developing cartridge according to claim 1, further comprising:

a supply roller configured to supply the developer to the developing roller, the supply roller including a supply roller shaft extending in the first direction, wherein the electrode is configured to be electrically connected to the supply roller shaft.

4. The developing cartridge according to claim 1, wherein the first protrusion has an outer end in the first direction and the outer end of the first protrusion is farther from the outer surface than an outer end of the developing roller shaft in the first direction.

5. The developing cartridge according to claim 1, wherein the electrode is made of a conductive resin.

6. The developing cartridge according to claim 1, wherein the electrode is attached to the outer surface.

7. The developing cartridge according to claim 1, wherein the developing roller further includes a roller portion covering at least a portion of a circumference of the developing roller shaft, wherein the casing includes a first wall and a second wall separated from the first wall in the first direction, wherein the roller portion is positioned between the first wall and the second wall, and wherein the first protrusion is positioned at an outer surface of the first wall and protrudes outward in the first direction.

8. The developing cartridge according to claim 1, wherein the second protrusion is contactable with an electrical contact of an image forming apparatus when the developing cartridge is attached to the image forming apparatus.

9. The developing cartridge according to claim 1, wherein the electrode is a bearing being made of a conductive resin.

10. A developing cartridge comprising:

a casing configured to accommodate developer therein;

a developing roller including a developing roller shaft extending in a first direction;

a first protrusion positioned at an outer surface of the casing, the first protrusion protruding outward from the outer surface in the first direction; and an electrode positioned at the outer surface, the electrode configured to be electrically connected to the developing roller shaft, the electrode including a second protrusion protruding outward in the first direction and the second protrusion having an inner space extending in the first direction, the inner space being positioned in the second protrusion, wherein the second protrusion has a first end portion and a second end portion, the first end portion and the second end portion arranged in a second direction crossing the first direction, the first end portion being closer to the developing roller shaft than the second end portion, wherein the first protrusion is located in a part of the inner space, the part of the inner space being closer to the first end portion than the second end portion in the second direction.

11. A developing cartridge comprising:

a casing configured to accommodate developer therein;

a developing roller including a developing roller shaft extending in a first direction;

a first protrusion positioned at an outer surface of the casing, the first protrusion protruding outward from the outer surface in the first direction; and an electrode positioned at the outer surface, the electrode configured to be electrically connected to the developing roller shaft, the electrode including a second protrusion protruding outward in the first direction and the second protrusion having an inner space extending in the first direction, the inner space being positioned in the second protrusion, wherein the first protrusion is positioned in the inner space, wherein the second protrusion has a first end portion and a second end portion, the first end portion and the second end portion arranged in a direction crossing the first direction, the first end portion being closer to the developing roller shaft than the second end portion, wherein the developing cartridge further comprises:

a third protrusion protruding outward from the outer surface in the first direction, the third protrusion being positioned at an opposite side of the developing roller shaft with respect to the first protrusion; and a fixing member configured to fix the second end portion to the third protrusion.

12. The developing cartridge according to claim 11, wherein the second end portion has a through hole, wherein the fixing member is inserted into the through hole and the fixing member is configured to fix the second end portion to the third protrusion.

13. The developing cartridge according to claim 12, wherein the fixing member is a screw.

14. The developing cartridge according to claim 13, wherein a portion of the second protrusion is positioned between an axis of the developing roller shaft and an axis of the screw.

15. The developing cartridge according to claim 11, wherein the outer surface of the casing has a first surface and a second surface, the first surface extending in a second direction crossing the first direction, the second surface being farther from the outer surface than the first surface in the first direction, wherein at least a portion of the first protrusion protrudes from the second surface, and wherein the third protrusion protrudes from the first surface.

* * * * *